US005656868A

United States Patent [19]

Gottlieb et al.

[11] Patent Number: 5,656,868

[45] Date of Patent: Aug. 12, 1997

[54] REMOTE VEHICLE STARTER FOR A STANDARD TRANSMISSION VEHICLE

[75] Inventors: Mark Gottlieb, Fairfax Station, Va.; Alex McPheeters, Brookeville, Md.

[73] Assignee: Designtech International Inc., Springfield, Va.

[21] Appl. No.: 542,378

[22] Filed: Oct. 12, 1995

[51] Int. Cl.[6] ..... F02N 17/00

[52] U.S. Cl. ..... 307/10.6; 123/179.2

[58] Field of Search ..... 307/9.1–10.6; 123/198 DC, 179.2–179.4; 180/287, 167; 340/429.9, 426, 825.3–825.32, 825.69, 825.72; 290/37 R, 38 C, 38 R

[56] References Cited

U.S. PATENT DOCUMENTS

| | | | |
|---|---|---|---|
| 3,646,515 | 2/1972 | Vodehnal | 307/10.3 |
| 3,685,606 | 8/1972 | Blow, Jr. | 290/38 C |
| 4,291,653 | 9/1981 | Tucker | 123/179.2 |
| 4,392,059 | 7/1983 | Nespor | 290/38 C |
| 4,674,454 | 6/1987 | Phairr | 290/38 C |
| 5,024,186 | 6/1991 | Long et al. | 307/10.6 |
| 5,115,145 | 5/1992 | Westberg et al. | 307/10.3 |
| 5,129,376 | 7/1992 | Parmley | 123/179.2 |
| 5,197,316 | 3/1993 | Gottlieb et al. | 70/45 |

*Primary Examiner*—Richard T. Elms

*Attorney, Agent, or Firm*—Oblon, Spivak, McClelland, Maier & Neustadt, P.C.

[57] ABSTRACT

A remote vehicle starter which can find implementation in a standard transmission vehicle. The remote vehicle starter has an operation for supplying power to an ignition and accessory wire when a key is removed from an ignition switch of the vehicle, so that the vehicle is running after the key is removed. It is then determined whether the vehicle is placed in neutral after the key is removed from the ignition switch. The remote vehicle starter of the present invention is then controlled so as to be operable to remotely start the vehicle only if the vehicle was in neutral at a point in time after the key is removed from the ignition switch.

6 Claims, 2 Drawing Sheets

REMOTE VEHICLE STARTER FOR A STANDARD TRANSMISSION VEHICLE

BACKGROUND 0F THE INVENTION

1. Field of the Invention

The present invention is directed to a remote vehicle starter which can remotely start vehicles which have a standard transmission.

2. Discussion of the Background

Remote vehicle starters are known. A remote vehicle starter is a device which allows an operator to start a vehicle without having to turn the ignition key, and normally by a remote control key-chain type transmitter. In one typical use, an operator of a remote vehicle starter will remotely start the vehicle on a cold day to allow the vehicle to become warmed up prior to the operator actually having to go inside the vehicle. A remote vehicle starter can also be used any other time that an operator wishes to pre-start a vehicle prior to the operator arriving at the vehicle.

One of the requirements with conventional remote vehicles starters is that conventional remote vehicles starters must be installed on automatic transmission vehicles so that in the event that the vehicle is left out of park, the vehicle cannot be remotely started. That is, conventionally a remote vehicle starter can be installed only on an automatic transmission vehicle because if it is attempted to remotely start the automatic transmission vehicle when the automatic transmission vehicle is out of park, the automatic transmission vehicle will not start, because automatic transmission vehicles do not start out of park.

However, standard transmission vehicles do not afford this luxury of automatic transmission vehicles in that a standard transmission vehicle will start and possible lunge forward if it is started out of park. That is, if a remote vehicle starter is installed on a standard transmission vehicle, and the standard transmission vehicle is not left in neutral, then when the operator attempts to remotely start this standard transmission vehicle the standard transmission vehicle will start and may lunge forward or drive as it is starting. As a result, conventional remote vehicle starters can not be installed on standard transmission vehicles. In this way there is a significant drawback in that conventional remote vehicle starter systems cannot be installed in standard transmission vehicles.

SUMMARY OF THE INVENTION

Accordingly, one object of the invention is to provide a novel remote vehicle starter which will ensure that the vehicle cannot be remotely started if the vehicle is not in neutral.

As a result, the system of the present invention provides a novel remote vehicle starter which can be easily and efficiently utilized in a standard transmission vehicle.

The present invention achieves its objectives by implementing a novel remote vehicle starter which can find implementation in a standard transmission vehicle. The remote vehicle starter of the present invention has an operation for supplying power to an ignition and accessory wire when a key is removed from an ignition switch of the vehicle, so that the vehicle is running after the key is removed. It is then assumed that the vehicle is in neutral at this time when the key is removed from the ignition switch and the driver exits the vehicle. The vehicle is then shut off from outside the vehicle by remote control. As long as the doors are not opened again, the remote starter remains operational for activation by the next command from the remote transmitter.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
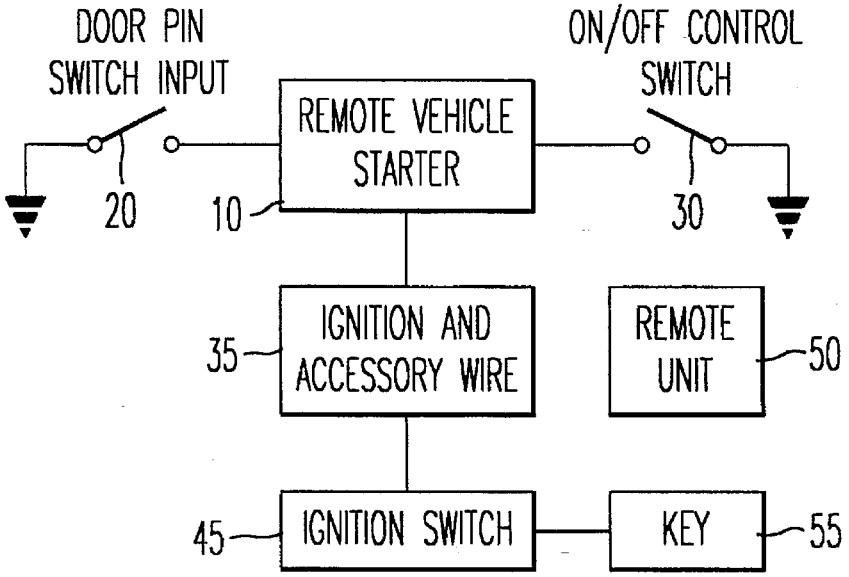
FIG. 1 is a block diagram of an implementation of the system of the present invention in a first embodiment.

Referring now to the drawings, wherein like reference numerals designate identical or corresponding parts throughout the several views, and more particularly to FIG. 1 of the present specification, there is shown the implementation of the system of the present invention in a first embodiment.

More specifically, as shown in FIG. 1, the present invention is directed to a remote vehicle starter 10 which receives as one input a door pin switch input 20 and which receives as another input an on/off control switch 30. A remote unit 50 can control the remote vehicle starter 10 to remotely start a vehicle.

In order to implement the system of the present invention, the remote vehicle starter 10 of the present invention should be operable in a mode which allows an operator to keep a vehicle running even after taking the key 55 out and leaving the vehicle. Such an operation may be referred to as a "pit-stop mode". Such a mode of the remote vehicle starter 10 operates as follows.

Assume that a vehicle arrives at an intended location and that the operator of the vehicle wishes to leave the vehicle unattended, but wishes to still maintain the vehicle to be running. In such a desired situation, the remote vehicle starter 10 of the present invention is operable so that if the on/off switch thereof is activated and deactivated in a certain predetermined order, e.g., off/on/off/on, this predetermined order activates the remote vehicle starter 10 to turn on the accessory and ignition wires 35 of the vehicle. In this situation, the driver can then remove the key 55 and since the remote vehicle starter 10 has the accessory and ignition wires on, the vehicle will continue to run. In one operation of the present invention, the remote vehicle starter 10 will run for up to 10 minutes unless turned off.

The use of this "pit-stop" mode in the present invention is a first step to allow the operation of the remote vehicle starter 10 of the present invention in a standard transmission vehicle. More specifically, by the following procedure, the system of the present invention allows operation of the remote vehicle starter 10 in a standard transmission vehicle.

Figure 3:
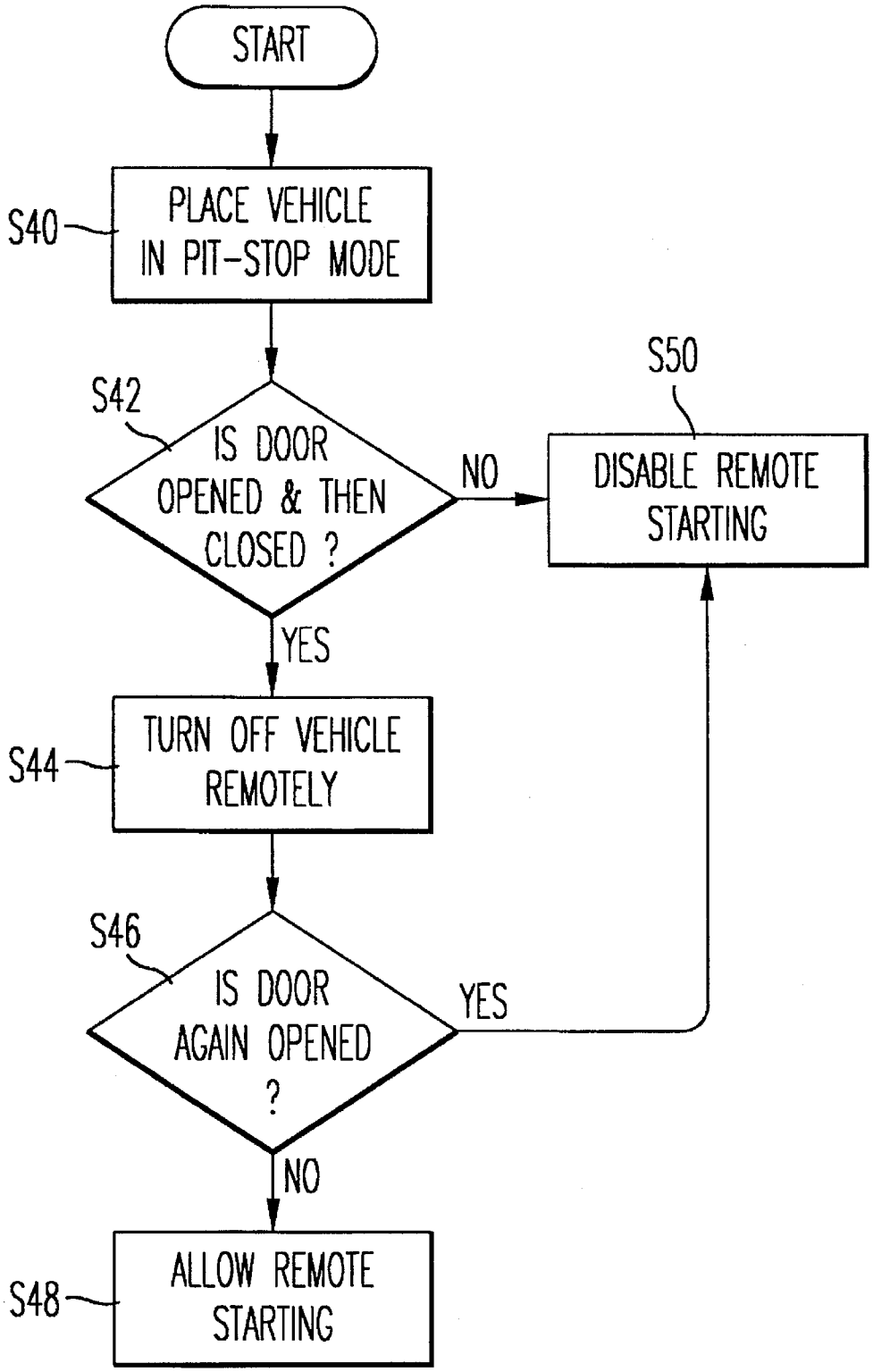
FIG. 3 shows a control algorithm in the system of the present invention.

First, and with reference to the flow chart in FIG. 3 of the present specification as an example, a vehicle arrives at a final destination and with the key still in the ignition and the vehicle running, the vehicle is placed in neutral. The operator of the vehicle then places the vehicle in the "pit-stop" mode, see step S40, by the required sequence of switching on the on/off switch in the remote unit, for example the sequence off/on/off/on. With this operation of the present invention, the remote vehicle starter 10 powers up the accessory and ignition lines. The key 55 is then removed from the ignition switch 45, but the vehicle remains running as it is operating in the "pit-stop" mode. Further, "smarts" can be added to insure that the vehicle is actually running, i.e. monitoring a tach signal or a battery voltage. Furthermore, since the vehicle is in neutral, the vehicle operator is allowed to exit the vehicle, as it would be very difficult for the operator to exit the vehicle if the vehicle is not in neutral.

As shown in FIG. 1 of the present specification, the remote vehicle starter 10 of the present invention also has a connection to the door pin switch and receives an input from the door pin switch so that the remote vehicle starter 10 can determine whether the door is opened.

As noted above, the vehicle is now in the "pit-stop" mode as the vehicle is still running at this time. After the vehicle operator exits the vehicle, the vehicle operator closes the door and the vehicle is still running, and the system of the present invention determines whether the vehicle door has been opened and closed while in the "pit-stop" mode, see step S42. At this point, the driver uses the remote unit 50 to turn off the remote vehicle starter 10, and to thereby turn off the vehicle, see step S44. If the vehicle door is not opened and then closed after being placed in the "pit-stop" mode and before the vehicle is remotely turned off, the remote starting operation is disabled, see step S50.

This operation of the present invention ensures that the vehicle was placed in neutral when turned off and the doors closed, and thus allows the remote vehicle starter 10 to start the vehicle at a later time, and it ensures that the door has not been re-opened. That is, the remote vehicle starter 10 of the present invention determines whether the door has been opened and then closed while the vehicle is still running, see step S42. If this situation occurs (YES), then the vehicle must have been in neutral when the driver exited the vehicle, and since the vehicle must have been in neutral, it is acceptable to allow the remote vehicle starter to remotely start the vehicle at a later point in time, as long as the vehicle door is not again opened and closed, see step S46. In this way, the remote vehicle starter 10 of the present invention allows the vehicle to be remotely started as long as the door is never opened again after it is turned off and after the driver exits the vehicle, and the driver remotely turns off the vehicle. If the door is again opened (YES in step S46), it is possible that the vehicle may have been shifted into gear, and the remote starting must be disabled, see step S50. Therefore, if the vehicle door is again opened a second time, see Step S46, after the driver exits the vehicle, then the remote vehicle starter 10 will be disabled so that the remote vehicle starter 10 cannot be used to remotely start the vehicle.

Figure 2:
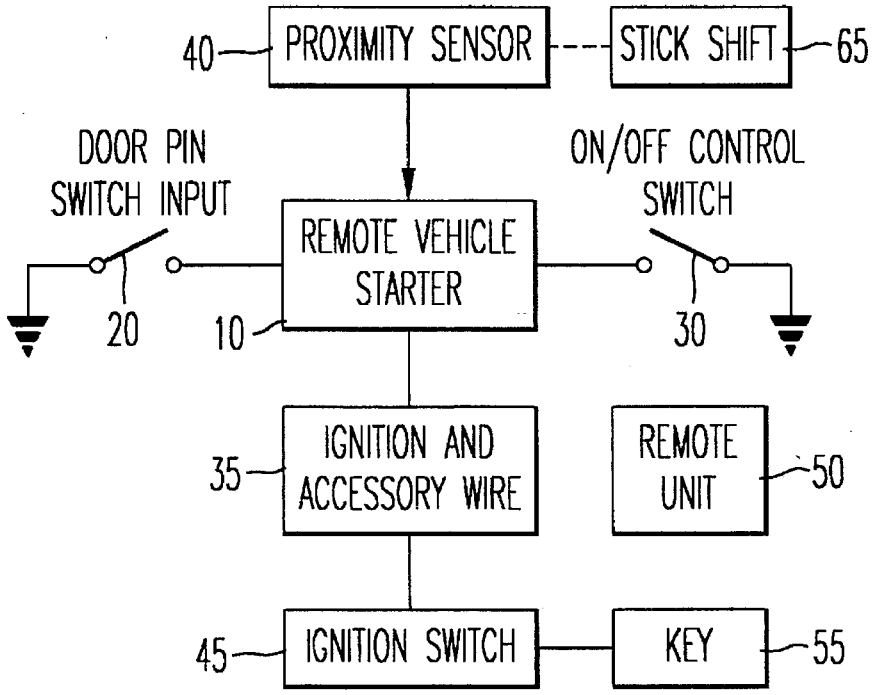
FIG. 2 is a block diagram of an implementation of the system of the present invention in a second embodiment.

As a second embodiment of the present invention, and as is shown in FIG. 2 of the present specification, an operation similar to the first embodiment of FIG. 1 is implemented except that the second embodiment of the present invention requires a further proximity sensor 40, and the connection to the door pin switch input is optional. This proximity sensor 40 is used to monitor the stick shift 65 in the standard transmission vehicle itself. This proximity sensor 40 may typically be a radar or microwave-type proximity sensor, which is a small sensor which can mount underneath the dash of the vehicle and which points towards the stick shift 65 itself. Such a radar-type proximity sensor can conventionally be tuned to have a field of view of any given size to which the sensor will respond in the event that anything moving enters the field of view. The operation of the system of the second embodiment as shown in FIG. 2 of the present specification operates the same as the first embodiment except that the door pin switch 20 does not need to be monitored, and instead the proximity sensor 40 determines whether the vehicle is parked in neutral, by the location of the stick shift 65, after the door is closed and before the door is opened again. Of course it is possible to use both systems shown in FIG. 1 and FIG. 2 of the present specification so that both the door pin switch activation 20 and the proximity sensor activation 40 must be in agreement before the remote vehicle starter 10 is authorized to remotely start a vehicle.

As discussed above, the starting point in the system of the present invention is operation in the pit-stop mode. However, this is not a requirement in that any operation which allows a vehicle operator to exit the vehicle while the vehicle is still running can be utilized in the system of the present invention.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A remote vehicle starter for a standard transmission vehicle, comprising:

means for supplying power to an ignition and accessory wire of the vehicle when a key is removed from an ignition switch of the vehicle so that the vehicle is running after the key is removed;

means for detecting if the vehicle is in neutral after the key is removed from the ignition switch; and control means for controlling the power supply means to provide power to the ignition and accessory wires to remotely start the vehicle, after the vehicle has turned off, only after the detecting means has detected that the vehicle is in neutral.

2. The remote vehicle starter according to claim 1, wherein the detecting means comprises a door position detector for detecting if a door of the vehicle is opened one time or more than one time after the key is removed from the ignition switch while the vehicle is running and after the vehicle is turned off remotely, and the detecting means determines that the vehicle is in neutral if the vehicle door is opened only once.

3. The remote vehicle starter according to claim 1, wherein the detecting means comprises a proximity detector for detecting a position of a stick shift of the vehicle to determine if the stick shift is in neutral.

4. A method of remotely starting a standard transmission vehicle, comprising the steps of:

supplying power to ignition and accessory wires of the vehicle when a key is removed from an ignition switch of the vehicle so that the vehicle is running after the key is removed;

detecting if the vehicle is in neutral after the key is removed from the ignition switch; and controlling the step of supplying power to provide power to the ignition and accessory wires to remotely start the vehicle, after the vehicle has turned off, only after the detecting step has detected that the vehicle is in neutral.

5. The method of remotely starting a standard transmission vehicle according to claim 4, wherein the detecting step detects if a door of the vehicle is opened one time or more than one time after the key is removed from the ignition switch while the vehicle is running and after the vehicle is turned off remotely, and the detecting step determines that the vehicle is in neutral if the vehicle door is opened only once.

6. The remote vehicle starter according to claim 4, wherein the detecting step detects a position of a stick shift of the vehicle to determine if the stick shift is in neutral.

* * * * *